US007217156B2

(12) United States Patent
Wang

(10) Patent No.: US 7,217,156 B2
(45) Date of Patent: May 15, 2007

(54) RF MICROWAVE CONNECTOR FOR TELECOMMUNICATION

(75) Inventor: Shun-Ping Wang, Hsin-Tien (TW)

(73) Assignee: Insert Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 11/037,201

(22) Filed: Jan. 19, 2005

(65) Prior Publication Data

US 2006/0160419 A1 Jul. 20, 2006

(51) Int. Cl.
*H01R 9/05* (2006.01)

(52) U.S. Cl. ..... 439/579

(58) Field of Classification Search ..... 439/579, 439/389–425, 607–610
See application file for complete search history.

(56) References Cited

U.S. PATENT DOCUMENTS 4,641,906 A * 2/1987 Olsson ..... 439/465
4,790,775 A * 12/1988 David ..... 439/579
4,840,578 A * 6/1989 Sato ..... 439/395
5,055,062 A * 10/1991 Sato ..... 439/395
5,733,146 A * 3/1998 Block ..... 439/610

* cited by examiner

*Primary Examiner*—J. F. Duverne
(74) *Attorney, Agent, or Firm*—Troxell Law Office, PLLC

(57) ABSTRACT

A RF microwave connector for telecommunication comprises a plug; a metal housing of the plug is combined with an insulator; a female terminal is combined with the hollow portion of the insulator; the female terminal has a main body, two opposite contact plates are extended from two sides of one end of the main body for clamping a male terminal; an arc shape of clamping section is disposed at another end of the main body, two edges of the clamping section are symmetrically arched so as to allow the edges of the clamping section to be bended oppositely smoothly to clamp inner wires of a coaxial cable stably when that the clamping section is combined with the inner wires is processed.

3 Claims, 7 Drawing Sheets

RF MICROWAVE CONNECTOR FOR TELECOMMUNICATION

BACKGROUND OF THE INVENTION

1. Field of the Invention

The present invention relates to an electric connector, and more particularly to a RF (Radio Frequency) microwave connector for telecommunication.

2. Description of Related Art

Please refer to FIGS. 1A and 1B. A conventional coaxial microwave connector consists of a plug and a receptacle, in which the plug has a female terminal 10. Two opposite contact plates 11 are disposed at one side of the female terminal 10 and a stop plate 12 is disposed at another side thereof. A slit 121 exists in the stop plate 12. The contact plates 11 are used to clamp a male terminal of the receptacle. The slit 121 is used to allow the inner wires 131 of a coaxial cable 13 to be passed through it and welded on the upper side of the female terminal 10, as FIG. 1B shows.

Please refer to 2A and 2B. Another conventional coaxial microwave connector, a plug thereof has a female terminal 20. Two opposite contact plates 21 are disposed at one side of the female terminal 20 and opposite stop plate 22 and raised plate 23 are disposed at another side thereof, in which a slit 221 exists in the stop plate 22. The contact plates 21 are used to clamp a male terminal of a receptacle. The slit 221 is used to allow the inner wires 241 of a coaxial cable 24 to be passed through it and welded at the upper side of the female terminal 20, as FIG. 2B shows.

The U.S. Pat. No. 6,648,653 entitled "super mini coaxial microwave connector" discloses a plug and a receptacle, in which the plug has a metal housing; the metal housing is connected to an insulator and a female terminal is connected with the hollow portion of the insulator. Please refer to FIG. 3. A female terminal 30 has two opposite contact plates 31 and two opposite stop plates 32 and an upper plate 33. The contact plates 31 are used to clamp a male terminal of the plug and inner wires 361 of a coaxial cable 36 are welded on the upper plate 33 and between the stop plates 32.

The manufacturing way welding the coaxial cable and the female terminal manually mentioned above cannot be replaced with an automatic machine manufacturing way, it is labor and time wasting.

Please refer to FIGS. 4A to 4C. Two opposite contact plates 41 are disposed at one end of another kind of known coaxial microwave connector 40 and a clamping section 42 is disposed at another end thereof. Two contact plates 41 are used to clamp a male terminal of a receptacle. The bottom of the clamping section 42 is formed as an arc shape and a bendable edge 421 is extended upward from one side of the bottom thereof. Inner wires 431 of a coaxial cable 43 are wrapped in between the bottom of the clamping section 42 and the bended bendable edge 421, as FIG. 4B shows.

Although an automatic machine can replace manual labor in the manufacturing way clamping the inner wires 431 of the coaxial cable 43 tightly by bending the bendable edge 421 of the clamping section 42 mentioned above is rather labor and time saving, the bendable edge 421 is very long and a more sophisticated and expensive bending facility is needed to bend the bendable edge 421 into a half circle type smoothly to contact closely with another edge of the arc bottom. If the bended radian of the bendable edge 421 is not smooth so that it cannot contact closely with another edge of the arc bottom of the clamping section 42, this will influence the function clamping the inner wires 431 closely and further influence the transmission quality of the connector and produce a bad product.

SUMMARY OF THE INVENTION

For improving the combination structure of a terminal of a plug of a coaxial microwave connector and inner wires of a coaxial cable, allowing the manufacturing more convenient and cheap and enabling the ratio of bad product rate to be lowered down, the present invention is proposed.

The main object of the present invention is to provide a RF microwave connector for telecommunication, enabling a manufacturing combination between a female terminal of a plug and inner wires of a coaxial cable to be easier.

Another object of the present invention is to provide a RF microwave connector for telecommunication, enabling a female terminal of a plug to be combined with inner wires of a coaxial cable tightly and not to loose so as to enhance the good product rate.

Still another object of the present invention is to provide a RF microwave connector for telecommunication, even if using simpler and cheaper machine, a female terminal of a plug and inner wires of a coaxial cable can be combined tightly.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 2A:
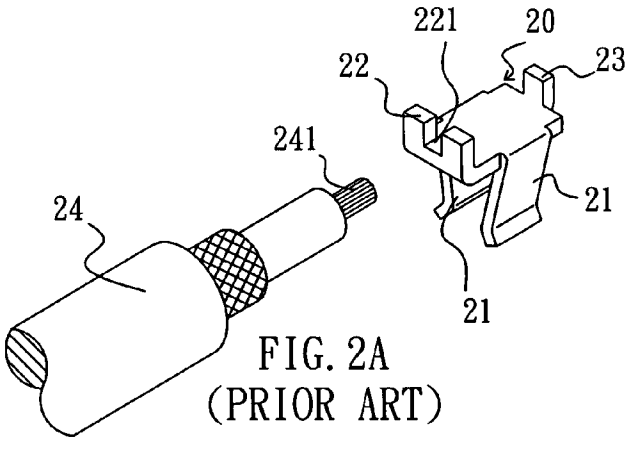
FIG. 2A (PRIOR ART)
FIGS. 2A and 2B are schematic views, respectively showing the separation and the combination of a second kind of conventional female terminal and coaxial cable.
Figure 2B:
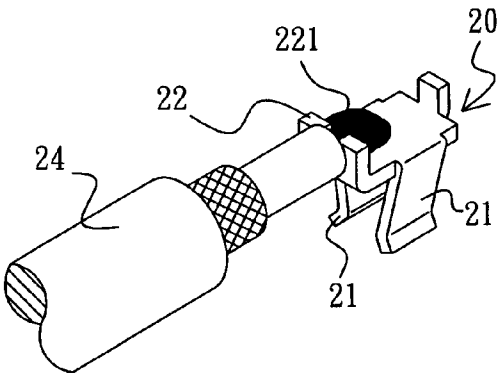
FIG. 2B (PRIOR ART)
Figure 1A:
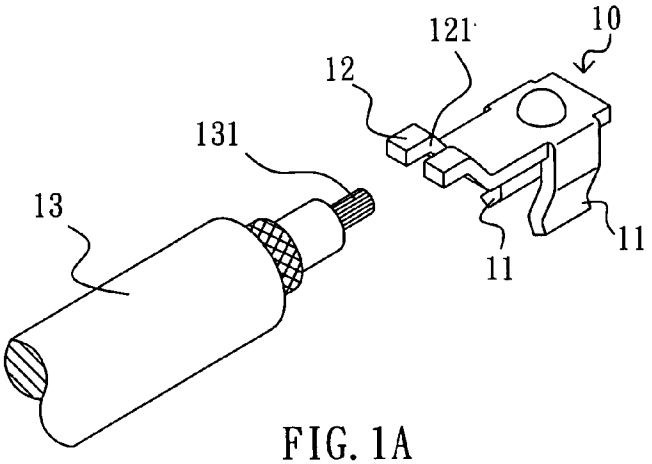
FIG. 1A (PRIOR ART)
FIGS. 1A and 1B are schematic views, respectively showing the separation and the combination of a first kind of conventional female terminal and coaxial cable.
Figure 1B:
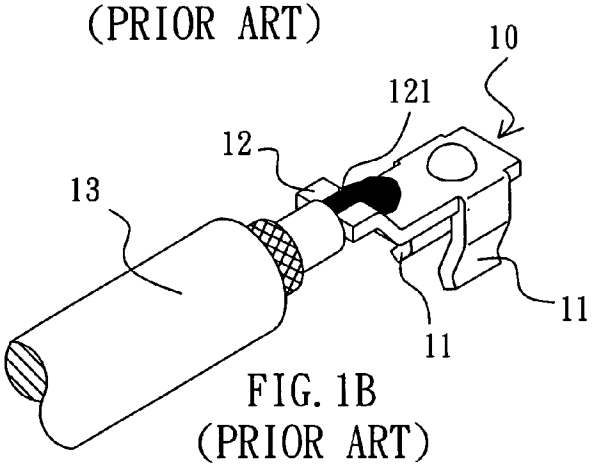
FIG. 1B (PRIOR ART)
Figure 4B:
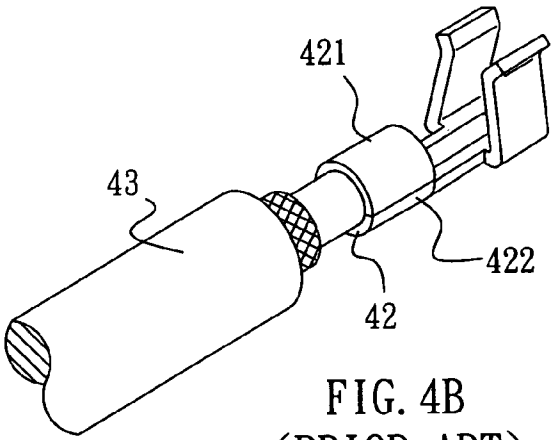
FIG. 4B (PRIOR ART)
FIGS. 4A and 4B are schematic views, respectively showing the separation and the combination of a fourth kind of conventional female terminal and coaxial cable.
Figure 4C:
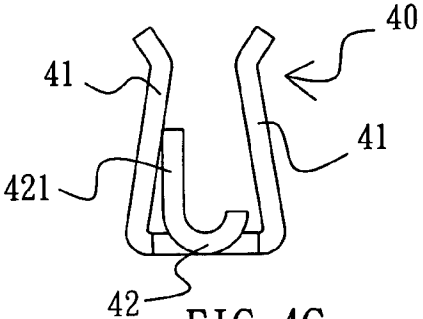
FIG. 4C (PRIOR ART)
FIG. 4C is a side view, showing a fourth kind of conventional female terminal.
Figure 3:
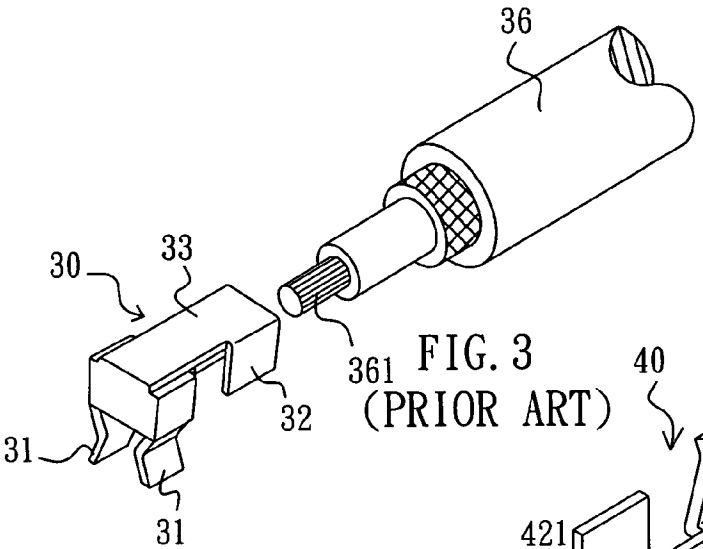
FIG. 3 (PRIOR ART)
FIG. 3 is a schematic view, showing the separation of a third kind of conventional female terminal and coaxial cable.
Figure 4A:
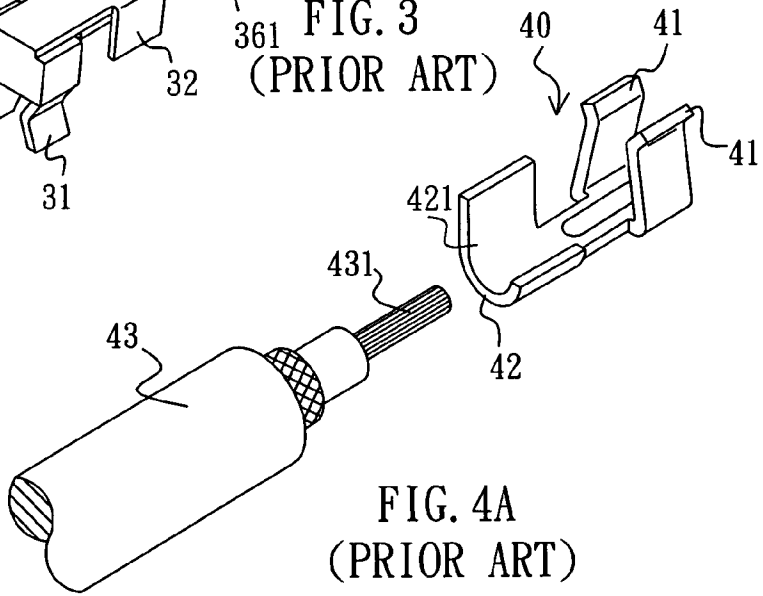
FIG. 4A (PRIOR ART)
Figure 5C:
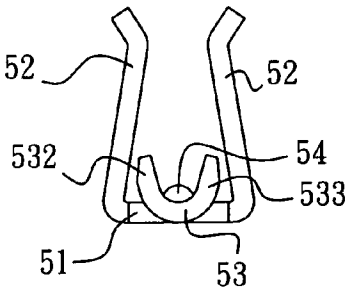
FIG. 5C is a side view, showing a female terminal of a first preferred embodiment according to the present invention.
Figure 5D:
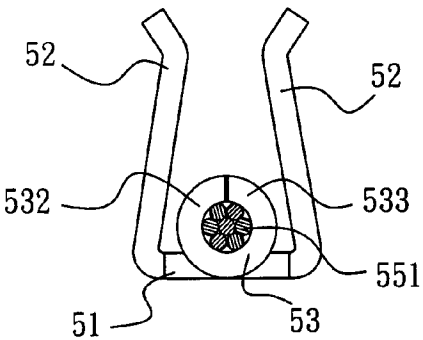
FIG. 5D is a schematic view, showing the combination of a female terminal and inner wires of a coaxial cable of a first preferred embodiment according to the present invention.
Figure 5A:
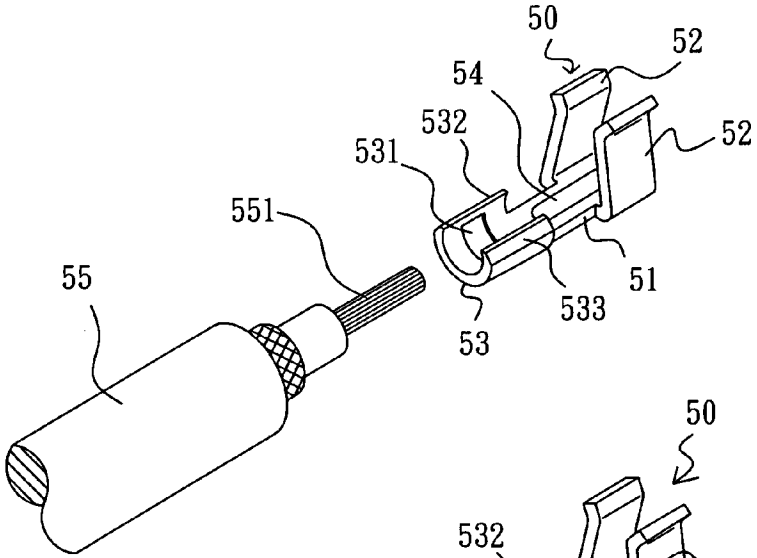
FIGS. 5A and 5B are schematic views, respectively showing the separation and the combination of a female terminal and coaxial cable of a first preferred embodiment according to the present invention.
Figure 5B:
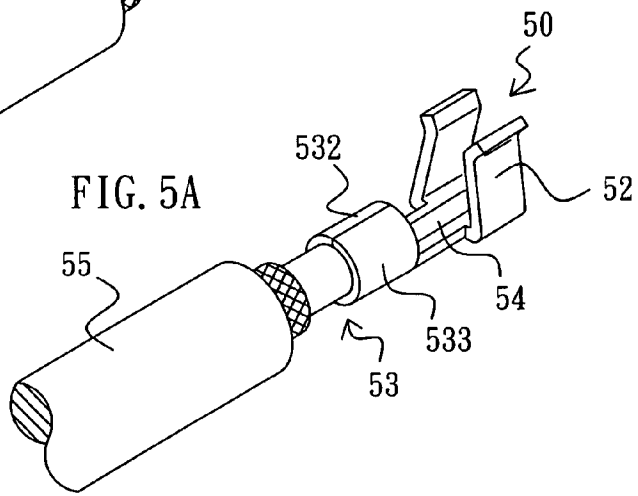

Please refer to FIGS. 5A to 5E. A female terminal 50 of a first preferred embodiment according to the present invention has a main body 51. Two opposite contact plates 52 are extended from the two sides of one end of the main body 51 used for combining with a male terminal. An arc shape of clamping section 53 is disposed at another end of the main body 51 and a groove hole 531 is disposed in the arc face of the clamping section 53. Two edges 532 and 533 of the clamping section 53 are symmetrically arched. A strip type of raised portion 54 is disposed on the surface of the inner side of the main body 51 close to the clamping section 53 and the raised portion 54 is extended between the contact plates 52.

The design that the two edges 532 and 533 of the clamping section 53 of the terminal 50 are symmetrically arched in the preferred embodiment is suitable for using only a simpler and cheaper manufacturing machine, the edges 532 and 533 can be bended face to face smoothly to clamp inner wires 551 of a coaxial cable 55 stably. The raised portion 54 is used to limit the length that the inner wires 551 is extended into the clamping section 53 when the clamping section 53 is forced to clamp the inner wires 551 of the coaxial cable 55, i.e. the front end of the inner wires 551 will touch the raised portion 54 and are positioned there after the inner wires 551 is placed in the inner side of the clamping section 53. Therefore, having the design of the raised portion 54 in the female terminal 50, that the inner wires 551 reaches the position subjected to clamp can be ascertained when the inner wires 551 of the coaxial cable 55 are processed to clamp. In the process that the inner wires 551 is clamped by the clamping section 53, the part of the inner wires 551 corresponding to the groove hole 531 is deformed by the force and sunk into the groove hole 531. When the coaxial cable 55 is exerted by a pull force to cause it to be separated from the clamping section 53, the inner wire 551 rather not be caused to separate from the clamping section 53 because there is a resisting force yielded from the deformation part of the inner wires 551 sunk in the groove hole 531.

Figure 6A:
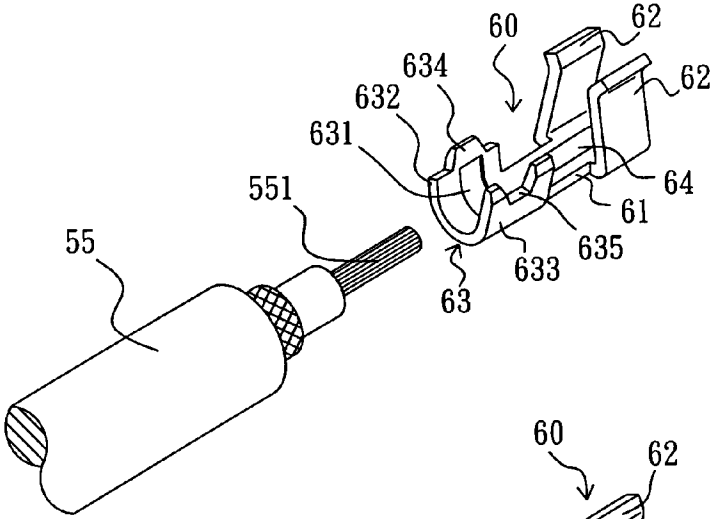
FIGS. 6A and 6B are prospective views, respectively showing the separation and the combination of a female terminal and a coaxial cable of a third preferred embodiment according to the present invention.
Figure 6B:
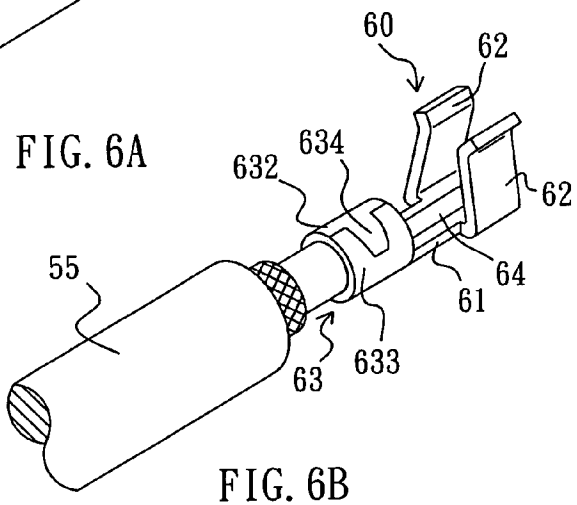
Figure 5E:
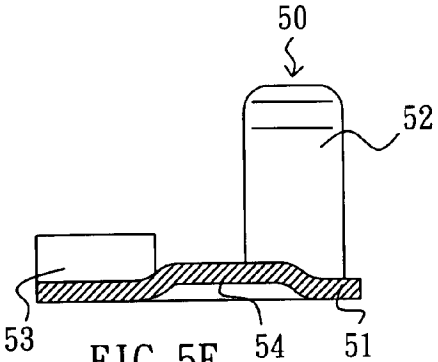
FIG. 5E is another side view, showing a female terminal of a first preferred embodiment of the present invention.
Figure 6C:
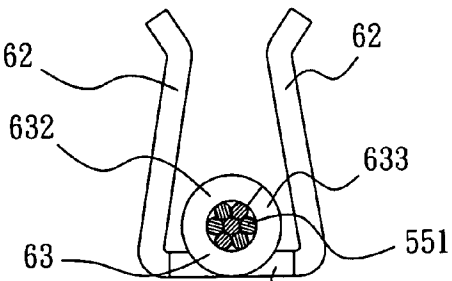
FIG. 6C is an end view of the embodiment shown in FIGS. 6A and 6B.

Please refer to FIGS. 6A to 6C. A female terminal 60 of a second preferred embodiment according to the present invention whose shape is approximately same as the one of the female terminal 50 of a first preferred embodiment mentioned above also has a main body 61, two opposite contact plates 62, a clamping section 63, a groove hole 631 and a raised portion 64, and the difference between them is in that a corresponding tenon 634 and notch 635 are respectively disposed at the end parts of two edges 632 and 633 of the clamping section 63. When the edges 632 and 633 are bended, the tenon 632 is caused to buckle into the notch 635, this helps allowing the edges 632 and 633 to be bended symmetrically accurately and the contact ends to be stayed closely so that the crooked contact does rather not happen. Therefore, the largest clamping force is exerted on the inner wires 551 of the coaxial cable 55 to allow to be combined with the clamping section 63 more stably.

Figure 7C:
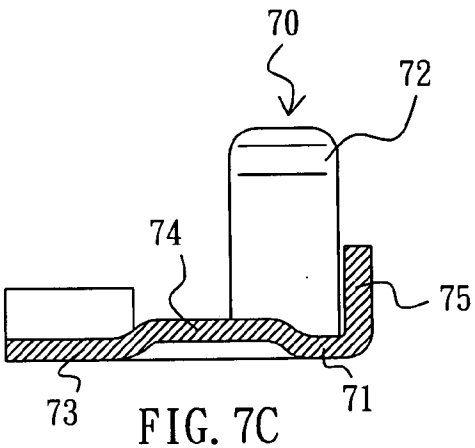
FIG. 7C is another side view, showing a female terminal of a third preferred embodiment according to the present invention.
Figure 7A:
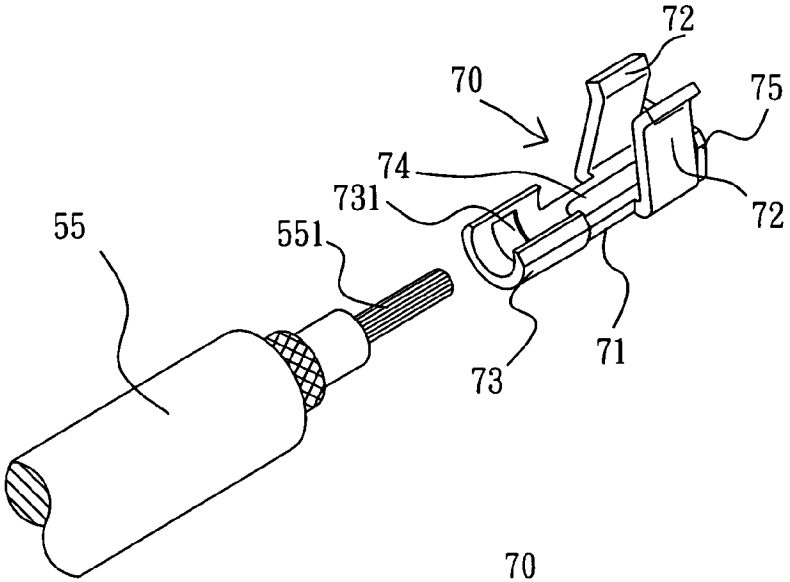
FIG. 7A is a prospective view, showing the separation of a female terminal and a coaxial cable.
Figure 7B:
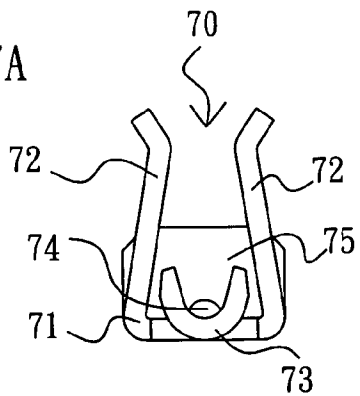
FIG. 7B is side view, showing a female terminal of a third preferred embodiment according to the present invention.

Please refer to FIGS. 7A to 7C. A female terminal 70 of a third preferred embodiment according to the present invention whose shape is approximately same as the one of the female terminal 50 of a first preferred embodiment mentioned above also has a main body 71, two opposite contact plates 72, a clamping section 73, a groove hole 731 and a raised portion 74, and the difference between them is in that a stop plate 75 is bended upward from the outside end of the contact plates 72 of the main body 72. The design of the stop plate 75 is used to allow the female terminal 70 to be positioned in the insulator of the plug more conveniently.

Figure 8:
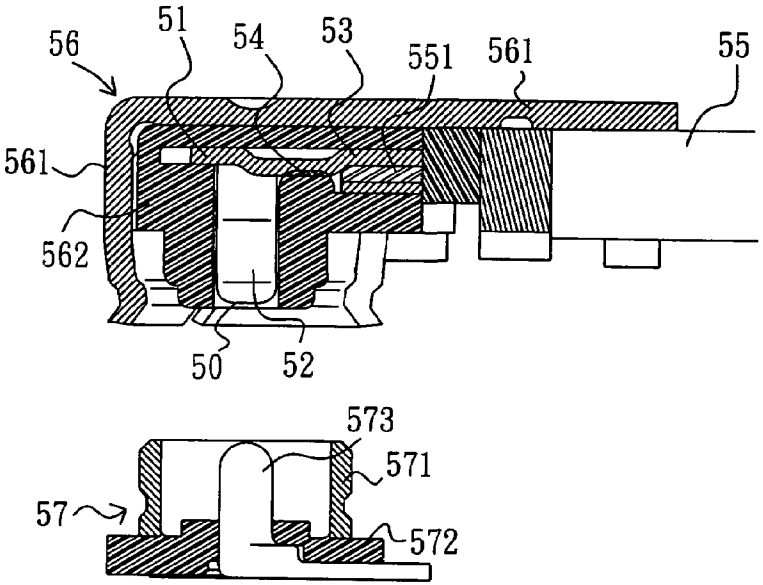
FIG. 8 is a cross sectional view, showing a plug and a receptacle of a first preferred embodiment of the present invention.

Please refer to FIG. 8. After the female terminal 50 of the first preferred embodiment is combined with the coaxial cable 55, they are combined in a plug 56. The plug 56 has a metal housing 561. The metal housing 561 is combined with an insulator 562. The hollow portion of the insulator 562 is combined with the female terminal 50 to allow the female terminal 50 not to contact with the metal housing 561. The receptacle 57 combined with the plug 56 has a metal housing 571 and an insulator 572 is combined at the lower end of the metal housing 571. The insulator 572 is extended inside of the metal housing 571 and a protruding end, which is combined with a male terminal 573, is formed at the center part thereof. The lower end of the male terminal 573 is extended outside of the insulator 572 and the metal housing 571. Engage contact plates 52 of the female terminal 50 of the plug 56 with the male terminal 573 of the receptacle 57 at the two sides thereof to cause two signal terminals to be communicated. Besides, the metal housing 561 is engaged with the metal housing 571 at the outside thereof to cause two grounds to be communicated.

Figure 9:
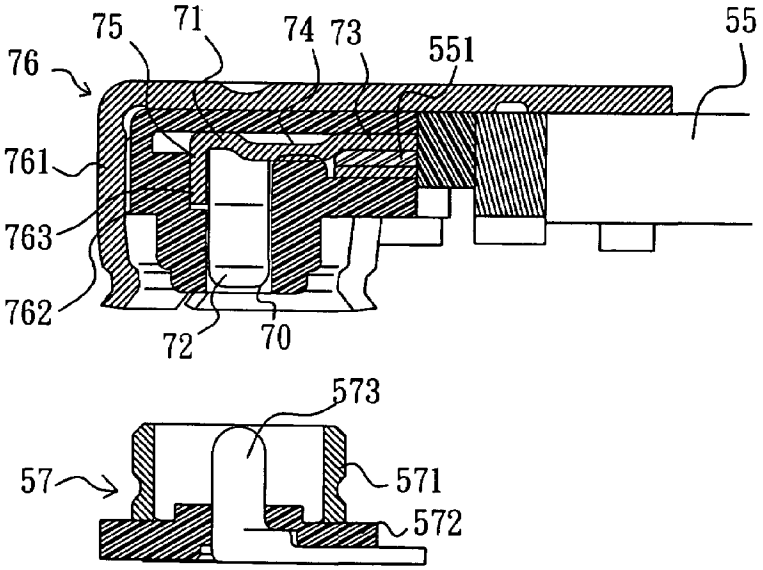
FIG. 9 is a cross sectional view, showing a plug and a receptacle of a third preferred embodiment according to the present invention.

Please refer to FIG. 9. After the female terminal 70 of the third preferred embodiment is combined with the coaxial cable 55, they are combined in a plug 76. The plug 75 has a metal housing 761. The metal housing 761 is combined with an insulator 762. The insulator 762 has a recess 763 for receiving the stop plate 75 of the female terminal 70. The design of the stop plate 75 allows the female terminal 70 to be positioned in the insulator 762 more conveniently. And, the plug 76 is also used for being inserted into the receptacle 57.

Figure 10B:
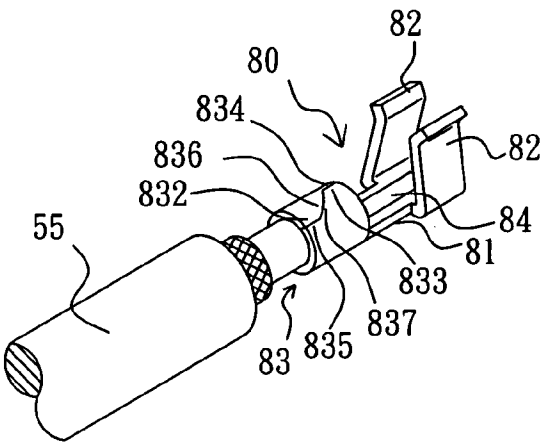
FIGS. 10A and 10B are schematic views, respectively showing the separation and the combination of a female terminal and coaxial cable of a fourth preferred embodiment according to the present invention.
Figure 10A:
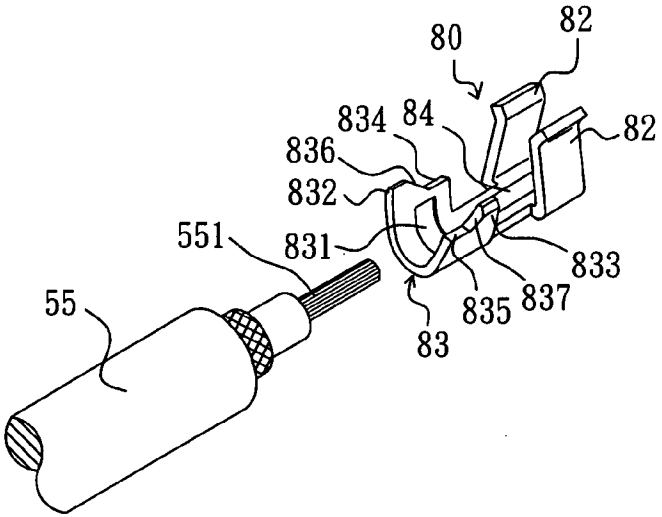
Figure 10C:
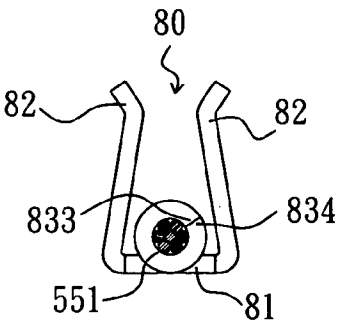
FIG. 10C is a side view, showing a female terminal of a fourth preferred embodiment according to the present invention.

Please refer to FIGS. 10A to 10C. A female terminal 80 of a fourth preferred embodiment according to the present invention whose shape is approximately same as the one of the female terminal 50 of a first preferred embodiment mentioned above also has a main body 81, two opposite contact plates 82, a clamping section 83, a groove hole 831 and a raised portion 84, and the difference between them is in that a corresponding raised sections 832, 833, recessed sections 834, 835 and inclined sections 836, 837 are respectively disposed at the end parts of two edges of the clamping section 83. when the two edges are bended, the raised section 832, the inclined section 836 and the recessed section 834 of one edge are caused to contact respectively with the recessed section 835, the inclined section 837 and raised section 833 of another edge, this helps allowing the edges to be bended symmetrically accurately and the contact ends to be stayed closely so that the crooked contact does rather not happen. Therefore, the largest clamping force is exerted on the inner wires 551 of the coaxial cable 55 to allow to be combined with the clamping section 83 more stably.

The combination structure of the terminal of the plug of the coaxial microwave connector and the inner wires of the coaxial cable in the present invention is obviously improved to allow the manufacturing to be more convenient, a simpler and cheaper manufacturing machine to be used and the bad product rate to be lowered down.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A RF microwave connector for telecommunication, comprising a plug; said plug having a metal housing, said metal housing being combined with an insulator; a female terminal being combined with the hollow portion of said insulator; said female terminal having a main body, two opposite contact plates being extended from two sides of one end of said main body for clamping a male terminal; an arc shape of clamping section being disposed at another end of said main body, two edges of said clamping section being symmetrically arched so as to allow the edges of said clamping section to be bended oppositely smoothly to clamp inner wires of a coaxial cable stably when that said clamping section is combined with said inner wires is processed, wherein a groove hole is disposed in the arc surface of said clamping section so that the part of said wires corresponding to said groove hole is deformed by a force and sunk into said groove hole when that said inner wires is clamped by the clamping section is processed.

2. A RF microwave connector for telecommunication, comprising a plug; said plug having a metal housing, said metal housing being combined with an insulator; a female terminal being combined with the hollow portion of said insulator; said female terminal having a main body, two opposite contact plates being extended from two sides of one end of said main body for clamping a male terminal; an arc shape of clamping section being disposed at another end of said main body, two edges of said clamping section being symmetrically arched so as to allow the edges of said clamping section to be bended oppositely smoothly to clamp inner wires of a coaxial cable stably when that said clamping section is combined with said inner wires is processed, wherein corresponding raised sections and recessed sections are respectively disposed at the ends of the two edges of said clamp, when the two edges are bended, the raised section and the recessed section of one edge are caused to contact respectively with the recessed section and the raised section of another edge.

3. The microwave connector according to claim 2, wherein corresponding inclined sections are respectively disposed between the corresponding raised sections and recessed sections of the ends of the two edges of said clamping section so that the inclined section sections of the two edges are caused to contact with each other when the two edges of said clamping section are bended.

* * * * *